US008382342B2

(12) United States Patent
Kim

(10) Patent No.: US 8,382,342 B2
(45) Date of Patent: Feb. 26, 2013

(54) TUNNEL LIGHT FIXTURE

(76) Inventor: In Suck Kim, Bucheon (KR)

( * ) Notice: Subject to any disclaimer, the term of this patent is extended or adjusted under 35 U.S.C. 154(b) by 731 days.

(21) Appl. No.: 12/096,983

(22) PCT Filed: Dec. 13, 2006

(86) PCT No.: PCT/KR2006/005436

§ 371 (c)(1),
(2), (4) Date: Sep. 24, 2009

(87) PCT Pub. No.: WO2007/069850

PCT Pub. Date: Jun. 21, 2007

(65) Prior Publication Data

US 2010/0014298 A1 Jan. 21, 2010

(30) Foreign Application Priority Data

Dec. 14, 2005 (KR) ..... 10-2005-0122869

(51) Int. Cl.
*F21V 21/00* (2006.01)

(52) U.S. Cl. ..... 362/374; 362/145; 362/217.1; 362/362; 362/375; 362/576

(58) Field of Classification Search ..... 362/145, 362/147, 217.1, 217.11–217.13, 253, 285, 362/362, 373, 559, 576, 580, 374–375
See application file for complete search history.

(56) References Cited

U.S. PATENT DOCUMENTS 5,838,860 A * 11/1998 Kingstone et al. ..... 385/100
6,641,278 B1 11/2003 Guritz
6,979,107 B1 12/2005 Bememsohn

FOREIGN PATENT DOCUMENTS

JP 05-282906 A 10/1993
JP 07-021808 A 1/1995

* cited by examiner

*Primary Examiner* — Meghan Dunwiddie
(74) *Attorney, Agent, or Firm* — Sughrue Mion, PLLC

(57) ABSTRACT

Disclosed herein is a tunnel light fixture that comprises an improved hinge-coupling mechanism to couple a body and a cover of the light fixture, and has an efficient packing structure capable of increasing the shielding efficiency between a lamp and a ballast to provide improved endurance and safety, and the tunnel light fixture comprises the body and the cover, and the body comprises a hinge-receiving part integral to the body and including a pair of shaft-receiving guides having a shaft groove, and a strut between the pair of shaft-receiving guides, and the cover comprises a hinge-inserting part integral to the cover corresponding to the hinge-receiving part and including a rotational bar having a strut recess formed at an intermediate portion of the rotational bar and a shaft extending from both sides of the rotational bar.

7 Claims, 3 Drawing Sheets

TUNNEL LIGHT FIXTURE

TECHNICAL FIELD

The present invention relates to tunnel light fixtures attached at constant intervals to the ceiling or the side wall of a tunnel in an express highway or other road, and, more particularly, to a tunnel light fixture that comprises an improved hinge-coupling mechanism to couple a body and a cover of the light fixture, and has an efficient packing structure capable of increasing the shielding efficiency between a lamp and a ballast to provide improved endurance and safety.

BACKGROUND ART

Generally, tunnel light fixtures are not only frequently exposed to great amounts of eddy current caused by vehicles traveling through a tunnel, but are also likely to be corroded due to various emissions. In particular, a coupled part of the light fixture suffers from severe corrosion due to use of calcium chloride and the like in winter. Conventionally, the tunnel light fixture is provided with a separate hinge-coupling mechanism to couple a body and a cover in combination with separate bolts and nuts, which are used to fasten the body and the cover through bolt holes formed in the body and cover. Therefore, the conventional tunnel light fixture requires not only individual fastening of the bolts and nuts through the bolt holes of the body and cover, but also a sealing operation with respect to the bolt holes and the like, causing an extended installation time. Furthermore, in the event where the hinge-coupling mechanism is corroded and separated from the light fixture, there is the possibility of serious traffic accident.

Moreover, since a lighting lamp in the tunnel light fixture is turned on day and night for a long period, air at high temperatures is likely to generate in the tunnel light fixture and noticeably reduces the lifetime of a ballast and the like, thereby causing frequent replacement and failure of the ballast and the like.

Furthermore, since the tunnel light fixture is generally installed in a humid and dusty environment, dust is likely to be attached to inner and outer surfaces of the light fixture and causes reduction in the cleaning cycle along with frequent failure, thereby providing a problem of requiring a further thorough sealing operation.

In a tunnel light fixture disclosed in Korean Patent Laid-open No. 2001-0103802, although a hinge-coupling mechanism for the light fixture is partially improved, a separate hinge-coupling mechanism is still required. In a tunnel light fixture disclosed in Korean Utility Model Registration No. 0377203, although a plurality of protrusions are formed on the body and cover to increase a cross-sectional area for heat dissipation, the cross-sectional area for heat dissipation increases slightly so that the heat dissipation is insufficient, thereby failing to maintain the lifetimes of other components. In a tunnel light fixture disclosed in Korean Utility Model Registration No. 20-0313767, a diaphragm is disposed to prevent heat of the lamp from being transferred to the ballast and other components, and a double-rubber packing is disposed along a rim of the body to improve sealing. However, since the diaphragm is coupled to the body through screw holes in the bottom of the body in a state of being separated a predetermined distance from the bottom of the body, and since the body faces upward in the light fixture and so heat is directed upward, there is still a problem in that most of the heat from the lamp is transferred to the ballast and the other components through a gap between the bottom of the body and the diaphragm. Since a recess is insufficiently formed on the body of the light fixture, the light fixture suffers from a problem in that the double-rubber packing is likely to slip from the body. In this case, although an existing wide rubber packing has stability in the light fixture, the existing wide rubber packing has a problem in that, since the existing wide rubber packing is located higher than the rim of the body in a packed state, it is likely to slip to the side of the body under compression of the cover.

DISCLOSURE OF INVENTION

Technical Problem

Therefore, the present invention has been made in view of the above problems, and an object of the present invention is to provide a tunnel light fixture that comprises an improved hinge-coupling mechanism formed by casting hinge-coupling parts with a body and a cover at the same time, to allow the body and the cover to be coupled easily through the improved hinge-coupling mechanism, and has an improved shielding structure to prevent heat of a lamp from reaching a ballast and other components, and an improved sealing structure between the body and the cover, thereby securing the endurance of the tunnel light fixture.

Technical Solution

In accordance with an aspect of the present invention, the above and other objects can be accomplished by the provision of a tunnel light fixture comprising a body where associated components including a lamp, a ballast and a shielding plate are accommodated, and a cover coupled to the body to open or close the body, wherein, in order to couple the body and the cover, the body comprises at least one hinge-receiving part integral to a rim of the body and including a pair of shaft-receiving guides having a shaft groove and a strut between the pair of shaft-receiving guides, and the cover comprises a hinge-inserting part integral to a rim of the cover corresponding to the hinge-receiving part and including a rotational bar having a strut recess formed at an intermediate portion of the rotational bar, and a shaft extending from both sides of the rotational bar, and wherein the hinge-inserting part is coupled to the hinge-receiving part as the shaft is received in the shaft-receiving guide and the rotational bar is seated on the strut. In addition, the strut recess may be joined with a filling member and the shaft-receiving guide may have an indentation to allow further easy coupling therebetween. Preferably, the body further comprises a shielding plate-receiving protrusion to receive the shielding plate such that the shielding plate is brought into close contact with the bottom of the body. The body may further comprises a packing member and a packing member-receiving groove formed along the rim of the body to receiving the packing member, wherein the packing member-receiving groove comprises an inner packing member holder and an outer packing member holder higher than the inner packing member holder, and the packing member may have a profile lower than that of the outer packing member holder and higher than that of the inner packing member holder. Furthermore, the body and the cover may be formed from an aluminum die-casting to achieve easy manufacturing, thermal conductivity, endurance, etc.

ADVANTAGEOUS EFFECTS

According to the present invention, the tunnel light fixture comprises an improved hinge-coupling mechanism integrally formed with a body and a cover to couple the body and the cover, thereby eliminating the danger caused by corrosion of a hinge and other components while securing a convenient assembling or dissembling operation and a sturdy structure. Furthermore, the tunnel light fixture comprises an improved installation structure of a shielding plate, which extends the lifetime of the tunnel light fixture and a firm sealing structure that protects the interior of the light fixture from various foreign substances.

DESCRIPTION OF REFERENCE NUMERALS FOR MAIN COMPONENTS OF THE DRAWINGS

Figure 1:
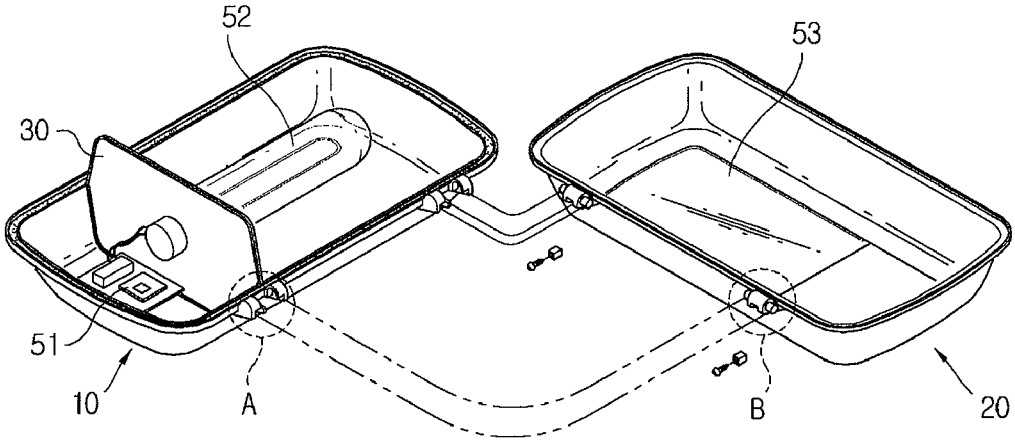
FIG. 1 is an exploded perspective view of a tunnel light fixture according to one embodiment of the present invention.

10: Body 11: Strut
12: Shaft-receiving guide 13: Shaft groove
14: Indentation 20: Cover
21: Shaft 22: Rotational bar
23: Strut recess 24: Filling member
25: Fastening member 30: Shielding plate
31: Shielding plate-receiving protrusion 41: Packing member
42: Outer packing member holder 43: Compressing protrusion
44: Packing member-receiving groove 45: Compressing member
46: Inner packing member holder 51: Ballast
52: Lamp
A: Hinge-receiving part B: Hinge-inserting part

BEST MODE FOR CARRYING OUT THE INVENTION

One exemplary embodiment of the present invention will be described in detail with reference to the accompanying drawings. It should be noted that like components are denoted by like reference numerals throughout the drawings. For a clear description of subject matters of the invention, detailed descriptions of associated well-known functions and configuration will be omitted.

FIG. 1 is an exploded perspective view of a tunnel light fixture according to one embodiment of the invention. The tunnel light fixture comprises a body 10 where various components such as a shielding plate 30, ballast 51, lamp 52, PCB, reflecting plate, etc. are accommodated, and a cover 20 that is coupled to the body to protect the various components and includes a transparent member 53 through which light from the lamp 52 is illuminated. Since the tunnel light fixture is installed to the ceiling or the sidewall of a tunnel with the body 10 positioned at an upper side and the cover 20 positioned at a lower side, coupling between the body 10 and the cover 20 is very important. Conventionally, since the body and the cover are coupled by a separate hinge through holes of the body and the cover, there is a problem in that a coupled part that includes the holes between the body and the cover is likely to be corroded. Chlorine ions of calcium chloride ($CaCl_2$) used as an anti-freezing agent in winter severely corrode metal and sulfur oxides contained in exhaust gas from vehicles further corrodes the metal by reacting with moisture in air which forms droplets of the sulfur oxides on part of the hinge. Furthermore, since eddy currents are frequently generated by vehicles driving through the tunnel or by other causes, and apply a large force to the light fixture, a severe traffic accident can occur in the event where the cover is separated from the body. According to the invention, in place of the separate hinge, a hinge-receiving part A is integrally formed with the body 10 by casting and a hinge-inserting part B is integrally formed with the cover 20 by casting, thereby providing a merit in that a hinge part of the light fixture is prevented from being damaged due to corrosion. According to the invention, since the hinge-receiving part A and hinge-inserting part B can be very easily fastened to each other, they enable the coupling operation to be convenient and rapid and provide excellent stability. Hereinafter, the hinge-receiving part A and hinge-inserting part B will be described in detail with reference to FIGS. 2 and 3.

Figure 2:
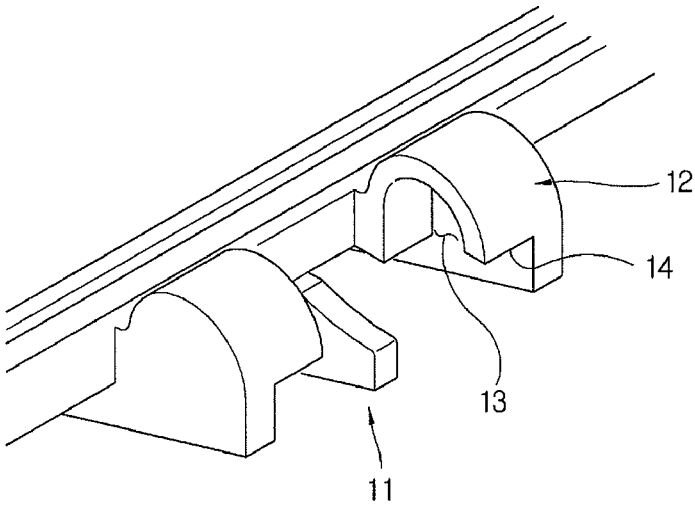
FIG. 2 is a detailed view of Part A of FIG. 1.
Figure 3:
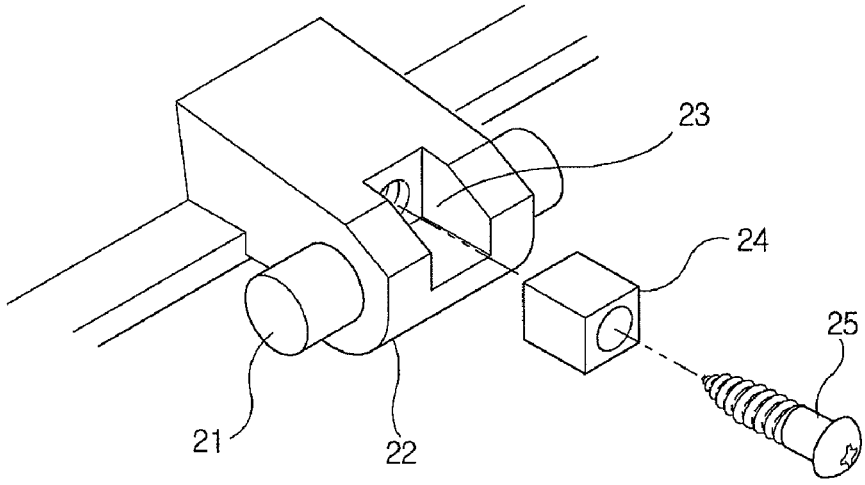
FIG. 3 is a detailed view of Part B of FIG. 1.

FIGS. 2 and 3 are detailed views of Parts A and B of FIG. 1. At least one hinge-receiving part A may be formed on a rim of the body 10. In this regard, it is general to form two hinge receiving parts A on the rim of the body 10. The hinge-inserting part B is formed on a rim of the cover 20 corresponding to the hinge receiving part of the body 10. Basically, the hinge-receiving part A is structured by a strut 11 and a pair of shaft-receiving guides 12, and the hinge-inserting part B is structured by a rotational bar 22, a shaft 21, and a strut recess 23. The shaft 21 extends from both sides of the rotational bar 22 to be inserted into the shaft-receiving guides 12 and has a cylindrical shape. Each of the shaft-receiving guides 12 has an arcuate space defined as a shaft groove 13 such that the shaft 21 can be received in the shaft groove 13 and rotated therein. The rotational bar 22 also has a cylindrical shape as a basic shape and is formed at an intermediate portion with the strut recess 23. When the hinge-receiving part A and the hinge-inserting part B are coupled, the rotational bar 22 is supported by the strut 11 and moves thereon.

The hinge-receiving part A and the hinge-inserting part B can be coupled to each other in a manner as shown in FIG. 1. The hinge-receiving part A and hinge-inserting part B cannot be coupled without laying down the cover 20 to some degree due to presence of the strut 11 and the peripheral shape of the shaft-receiving guides 12. Since the periphery of the shaft-receiving guide 12 is shaped like an enclosing dome to prevent the shaft 21 from entering the shaft-receiving guide 12 through the upper periphery thereof, the shaft 21 can be inserted into the shaft-receiving guides 12 through open parts of the shaft-receiving guides 12 other than the upper peripheries. In addition, since the strut 11 causes the rotational bar 22 to fail to enter the hinge-receiving part A, the rotational bar 22 is formed at the intermediate portion with the strut recess 23. Thus, with the shaft 21 inserted into the shaft-receiving guides 12 through the open parts of the shaft-receiving guides 12 after the strut 11 is fitted into the strut recess 23, the rotational bar 22 is seated on the strut 11 by slightly lifting the cover 20 and the shaft 21 is fitted into the shaft grooves 13, so that the shaft 21 is prevented from being separated from the shaft grooves 13. When separating the cover 20 from the body 10, first, the cover 20 is completely flipped open and pulled from the body 10 such that the strut 23 is inserted into the strut recess 23. Then, the shaft 21 is separated from the shaft-receiving guides 12 through the open parts of the shaft-receiving guides 12, so that the cover 20 can be separated from the body 10.

After coupling of the body 10 and the cover 20, a filling member 24 is attached to the strut recess 23, removing the space of the strut recess 23 into which the strut 11 can be inserted when the cover 20 is completely flipped open, so that the cover 20 can be opened within a predetermined angle from the body 10. It is apparent that an open degree of the cover 20 can be adjusted through a suitable adjustment in size of the filling member 24. To fasten the filling member 24 to the strut recess 23, various kinds of fastening member 25 can be used and a screw type fastening member is suggested as an exemplary one.

For more convenient coupling between the body and the cover, it is preferable that each of the shaft-receiving guides 12 has an indentation 14 formed at an edge. Even with the indentations 14 formed in the hinge-receiving part A, since the presence of the strut 11, diameter of the rotational bar 22, and upper surfaces of the shaft-receiving guides 12 serve to prevent the shaft 21 from slipping out even when the cover 20 is opened and pulled from the body 10, there is no problem caused by the indentations 14. An indented degree of the indentation 14 can be suitably adjusted so as to increase coupling convenience according to the dimensions of the strut, the diameter of the rotational bar, etc.

Meanwhile, according to the invention, even when the filling member 24 or the fastening member 25 is slipped out or removed, there is no possibility of separation between the body 10 and the cover 20 in a state wherein the cover 20 is closed on the body 10. With the conventional hinge-coupling mechanism, there is a possibility of separation between the body and the cover due to corrosion or various forces even in the closed state of the cover on the body. However, according to the invention, since the tunnel light fixture has the construction wherein the hinge-receiving part and the hinge-inserting part B are integral to the body and the cover, respectively, and coupled to each other, there is no such possibility. Therefore, the light fixture of the invention ensures high safety for traffic in the tunnel.

Figure 4:
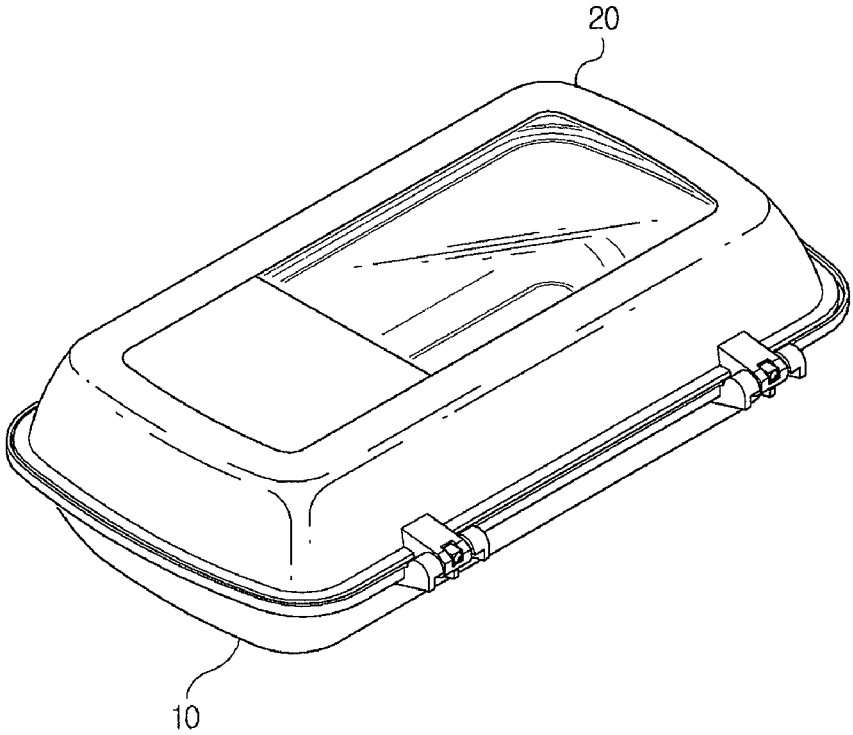
FIG. 4 is a perspective view illustrating a coupled state of the Parts A and B of FIG. 1.

FIG. 4 is a perspective view illustrating a coupled state of the Parts A and B of FIG. 1. Parts A and B are integral to the body and the cover, respectively, enabling very convenient assembly and disassembly between the body and the cover, so that the tunnel light fixture of the invention provides an excellent working efficiency compared with the conventional tunnel light fixture. As can be understood from FIG. 4 of the tunnel light fixture according to one embodiment of the invention, not only is the rotational bar supported by the strut, but also the filling member is brought into contact with the strut when the cover is opened, thereby determining an open degree of the cover.

Such a hinge-coupling mechanism according to the present invention can be applied not only to general light fixtures, but also to containers (having a barrel-shape) constituted by a body and a cover in order to couple the body and the cover.

Figure 5:
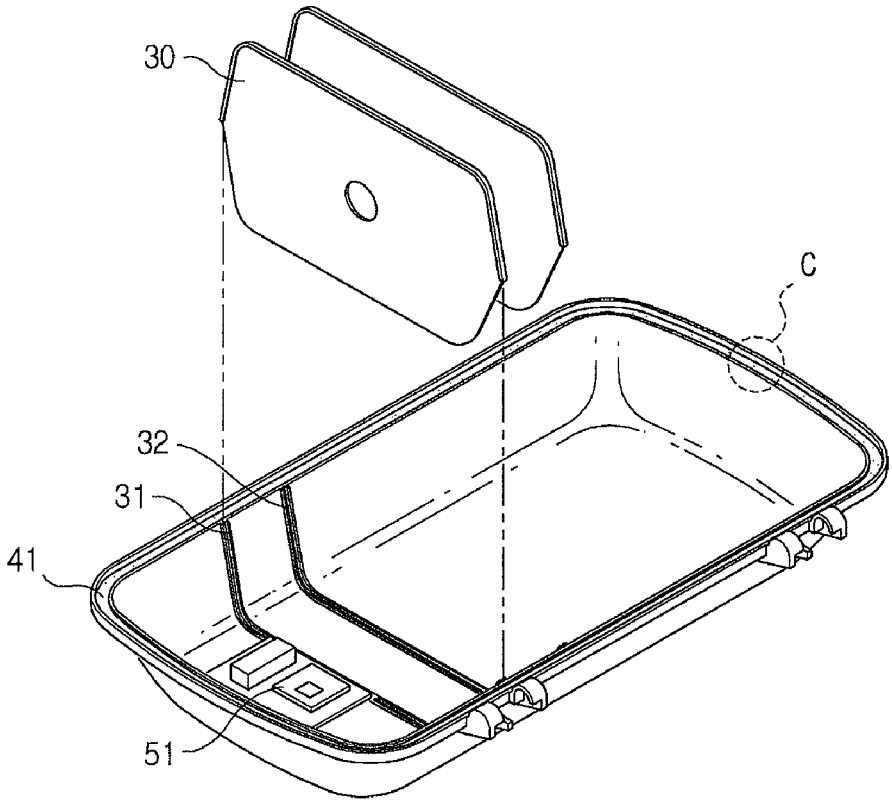
FIG. 5 is an exploded perspective view of a shielding plate-receiving protrusion of the tunnel light fixture.

FIG. 5 is an exploded perspective view of a shielding plate-receiving protrusion of the tunnel light fixture according to the invention. The body 10 accommodates the lamp, the ballast 51 connected in series to the lamp to prevent an increase of electric current, and the like. Meanwhile, if the inner temperature of the ballast 51 increases by 8~10?, the lifetime of the ballast 51 decreases by half. This causes frequent management and repair of the tunnel light fixture, and, since such repairs are not easy to perform within the tunnel, it is very important to provide endurance to the tunnel light fixture. Conventionally, although a shielding plate 30 is installed between the ballast and the lamp to prevent heat of the lamp from reaching the ballast 51, the lower side of the shielding pate 30 is spaced from the bottom of the body 10. In this regard, although it has been considered that, since the lamp is positioned above a reflection plate, the heat of the lamp could be sufficiently blocked only with installation of the shielding plate 30, such configuration fails to sufficiently block the heat in practice. Since the lamp is on day and night in a closed state, a significant quantity of heat is emitted from the lamp, and, since the bottom of the body 10 faces upward, the heat of high temperatures is transferred directly through the gap between the shielding plate 30 and the bottom of the body 10, causing reduction in lifetime of the ballast and other components. Therefore, according to the invention, a shielding plate-receiving protrusion 31 is formed along the bottom of the body 10, as shown in the figure, such that the shielding plate 30 is fitted into the shielding plate-receiving protrusion 31 of the body 10 without forming a space between the shielding plate 30 and the body 10.

Optionally, the body 10 may have another shielding plate-receiving protrusion 32. Considering that the shielding plate may have various sizes according to the various kinds and sized of lamp and associated components within the body, the other shielding plate-receiving protrusion 32 is provided for the purpose of enabling proper placement of the shielding plate 30. Furthermore, rubber packing may be provided to a portion of the shielding plate 30 fitted into the shielding plate-receiving protrusion 31 to secure complete sealing.

Figure 6:
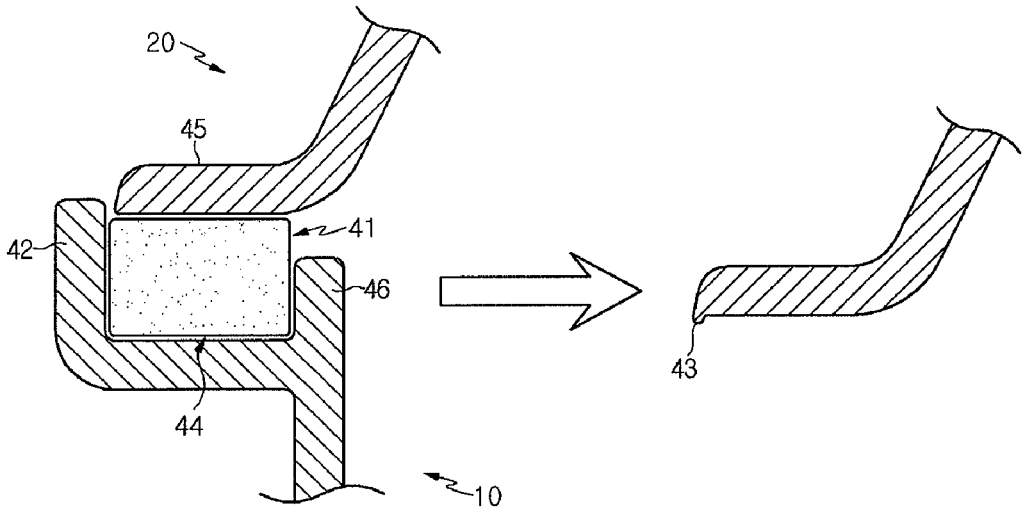
FIG. 6 is a detailed view of Part C of FIG. 5.

FIG. 6 is a detailed view of Part C of FIG. 5. A packing member-receiving groove 44 having a sufficient size is formed along the rim of the body 10 and is fitted with a packing member 41. Herein, an outer part of the packing member-receiving groove 44 is referred to as an outer packing member holder 42, and the outer packing member holder 42 has a higher profile than that of the packing member 41. Additionally, herein, an inner part of the packing member-receiving groove 44 is referred to as an inner packing member holder 46, and the inner packing member holder 46 has a lower profile than that of the packing member 41. Furthermore, the cover 20 comprises a compressing member 45 which has a compressing protrusion 43 formed at a lower side of the compressing member 45 to compress the packing member 41.

The conventional light fixture has a problem in that the packing member 41 can easily slip from the light fixture since a part for receiving the packing member 41 is not appropriately formed or has an insufficient depth. According to the invention, however, the packing member-receiving groove 44 has a sufficient depth. Moreover, in the conventional light fixture, since the packing member 41 has a higher profile than that of the outer packing member holder 42, a phenomenon occurs wherein the packing member 41 slips out or is twisted when the packing member 41 is compressed by the compressing member 45 of the cover 20. Meanwhile, by forming a plurality of small concaves on the body, it is possible to use a thin packing member (like an O-ring) in such a way that the packing member is inserted into the small concaves on the body and compressed by the cover. In an application to the tunnel light fixture, however, since the body 10 and the cover 20 are closed in a very strongly contacting state, it is considered that the packing member having a sufficient thickness and having a deformation force is more efficient. Furthermore, since the body 10 is positioned at the upper side, it is desirable that an outer circumference of the rim of the cover be inserted inside the rim of the body.

The packing member 41 may be inserted into and jointed to the packing member-receiving member 44. More preferably, the packing member is firmly secured thereto by a separate adhesive or an attachment device.

Meanwhile, it is important to protect various associated components within the body from heat and to prevent reduction in the lifetimes of the associated components through sufficient heat dissipation from the tunnel light fixture to the outside. For this purpose, according to the invention, the body and cover are formed from an aluminum die-casting. Since aluminum has an excellent thermal conductivity 14 times that of stainless steel at a temperature of 20? and a specific weight of at least 2.5 times lower than that of stainless steel, aluminum provides excellent endurance and stability. Furthermore, it is desirable to coat the whole body and cover.

It should be understood that the embodiments and the accompanying drawings as described above have been described for illustrative purposes and the present invention is limited by the following claims. Further, those skilled in the art will appreciate that various modifications, additions and substitutions are allowed without departing from the scope and spirit of the invention as set forth in the accompanying claims.

The invention claimed is:

1. A tunnel light fixture comprising a body where associated components including a lamp, a ballast and a shielding plate are accommodated, and a cover coupled to the body to open or close the body, wherein, in order to couple the body and the cover, the body comprises at least one hinge-receiving part integral to a rim of the body and including a pair of shaft-receiving guides having a shaft groove and a strut between the pair of shaft-receiving guides, and the cover comprises a hinge-inserting part integral to a rim of the cover corresponding to the hinge-receiving part and including a rotational bar having a strut recess formed at an intermediate portion of the rotational bar, and a shaft extending from both sides of the rotational bar, wherein the shaft-receiving guide has an indentation formed at an edge, and wherein the hinge-inserting part is coupled to the hinge-receiving part as the shaft is received in the shaft-receiving guide and the rotational bar is seated on the strut.

2. The tunnel light fixture according to claim 1, wherein the body further comprises a shielding plate-receiving protrusion to receive the shielding plate to block heat emitted from the lamp, a lower side of the shielding plate being inserted into the shielding plate-receiving protrusion and so brought into close contact with the bottom of the body.

3. The tunnel light fixture according to claim 1, wherein the body and the cover are formed from an aluminum die-casting.

4. The tunnel light fixture according to claim 1, wherein the strut recess is joined with a filling member.

5. The tunnel light fixture according to claim 1, further comprising:

a packing member; and a packing member-receiving groove formed along the rim of the body to receive the packing member, wherein the packing member-receiving groove comprises an inner packing member holder and an outer packing member holder higher than the inner packing member holder, and the packing member has a profile lower than that of the outer packing member holder and higher than that of the inner packing member holder.

6. A tunnel light fixture comprising a body where associated components including a lamp, a ballast and a shielding plate are accommodated, and a cover coupled to the body to open or close the body, wherein, in order to couple the body and the cover, the body comprises at least one hinge-receiving part integral to a rim of the body and including a pair of shaft-receiving guides having a shaft groove and a strut between the pair of shaft-receiving guides, and the cover comprises a hinge-inserting part integral to a rim of the cover corresponding to the hinge-receiving part and including a rotational bar having a strut recess formed at an intermediate portion of the rotational bar, and a shaft extending from both sides of the rotational bar, wherein the hinge-inserting part is coupled to the hinge-receiving part as the shaft is received in the shaft-receiving guide and the rotational bar is seated on the strut, and wherein the strut recess is joined with a filling member.

7. A tunnel light fixture comprising a body where associated components including a lamp, a ballast and a shielding plate are accommodated, and a cover coupled to the body to open or close the body, wherein, in order to couple the body and the cover, the body comprises at least one hinge-receiving part integral to a rim of the body and including a pair of shaft-receiving guides having a shaft groove and a strut between the pair of shaft-receiving guides, and the cover comprises a hinge-inserting part integral to a rim of the cover corresponding to the hinge-receiving part and including a rotational bar having a strut recess formed at an intermediate portion of the rotational bar, and a shaft extending from both sides of the rotational bar, wherein the hinge-inserting part is coupled to the hinge-receiving part as the shaft is received in the shaft-receiving guide and the rotational bar is seated on the strut, and wherein the tunnel light fixture further comprising:

a packing member; and a packing member-receiving groove formed along the rim of the body to receive the packing member, wherein the packing member-receiving groove comprises an inner packing member holder and an outer packing member holder higher than the inner packing member holder, and the packing member has a profile lower than that of the outer packing member holder and higher than that of the inner packing member holder.

* * * * *